US005093169A

United States Patent [19]

Sakuraba

[11] Patent Number: 5,093,169

[45] Date of Patent: Mar. 3, 1992

[54] INDOOR SPORT FLOOR MAT COMPRISING A PLURALITY OF FASTENABLE/UNFASTENABLE MAT UNITS

[75] Inventor: Tsuneaki Sakuraba, Saitama, Japan

[73] Assignee: Nagase Kenko Corporation, Tokyo, Japan

[21] Appl. No.: 547,223

[22] Filed: Jul. 3, 1990

[30] Foreign Application Priority Data

Mar. 13, 1990 [JP] Japan ..... 2-25454[U]

[51] Int. Cl.[5] ..... B32B 3/06

[52] U.S. Cl. ..... 428/44; 428/53; 428/58; 428/61; 428/33; 272/109

[58] Field of Search ..... 428/52, 33, 44, 53, 428/58, 61; 5/420; 272/109

[56] References Cited

U.S. PATENT DOCUMENTS 3,526,911 9/1970 Meyer et al. ..... 5/345
4,078,109 3/1978 Kando et al. ..... 428/52
4,350,721 9/1982 Nagase ..... 423/33

FOREIGN PATENT DOCUMENTS 3714210 11/1988 Fed. Rep. of Germany .

*Primary Examiner*—Alexander S. Thomas
*Attorney, Agent, or Firm*—Kenyon & Kenyon

[57] ABSTRACT

A floor mark used for a sport game is painted on the outer layer of a mat unit. A pair of mat units to be laid adjacent to each other are fastened together by means of a slide fastener. This slide fastener has a pair of fastener tapes, and a slider to be fitted around the guide sections of the paired fastener tapes. The fastener tape has a length substantially equal to that of the mat unit, and is covered with the outer layer throughout. Each fastener tape has a non-tooth guide section and a non-adhesion section which is not adhered to the outer layer. The non-adhesion section extends from one end of the fastener tape, and is longer than the non-tooth guide section. A positioning mark, used for adjusting the positions of the floor marks painted on the mat units, is painted or written on the surface of the fastener tape, such that the positioning mark is within the range of the non-adhesion section.

6 Claims, 7 Drawing Sheets

INDOOR SPORT FLOOR MAT COMPRISING A PLURALITY OF FASTENABLE/UNFASTENABLE MAT UNITS

BACKGROUND OF THE INVENTION

1. Field of the Invention

The present invention relates to a floor mat to be laid on the floor of a gymnasium or the like, and more particularly to a floor mat adapted for indoor sports and made up of a plurality of mat units which can be fastened or unfastened.

2. Description of the Related Art

U.S. Pat. No. 4,350,721 discloses an example of a conventional indoor sport floor mat. The indoor sport floor mat of the U.S. patent is made up of a plurality of mat units, and floor marks, such as lines used for sport games, are painted on the surface of each mat unit. The mat units to be laid adjacent to each other are fastened together by a slide fastener. This slide fastener is made up of a pair of fastener tapes, and a slider slidably fitted around the fastener tapes. Each fastener tape has a teeth train which is engageable with that of another fastener tape. Both end portions of the fastener tape are projected from the mat unit by 10 cm or so. The fastener tape is flexible, but has a certain degree of hardness.

The projected end portion of the fastener tape has a non-tooth guide section, and a positioning mark is written on the guide section. When the slider is at the non-tooth guide section, the fastener tapes can be slid relative to each other in the longitudinal direction of the non-tooth guide sections. The teeth train of one fastener tape and that of another can be brought into engagement with each other by first adjusting the positioning marks of the two guide sections and then pulling the slider toward the teeth trains. In this manner, a pair of mat units can be fastened together, with the floor marks on the mat units being adjusted in position.

The conventional floor mat mentioned above does not look very attractive, since the end portions of the fastener tape is projected from each mat unit. In addition, a player may trip on the end portion of the fastener tape. The fastener tape end portions can be fixed to the floor by means of an adhesive tape, but it is troublesome to fix all fastener tape end portions to the floor. It should be also noted that the fastener tape end portions are kept exposed even after they are fixed to the floor. Since they are trodden on by players, the positioning marks on them are likely to be worn away.

After the end of a game, the mat units are unfastened from one another and rolled up, so as to carry them easily. It should be noted, however, that the fastener tape end portions are kept projected from the rolled mat units. Such fastener tape end portions are dangerous when the mat units are being carried, since they may touch or scratch the body of a person carrying the rolled mat units.

SUMMARY OF THE INVENTION

Accordingly, an object of the present invention is to provide an indoor sport floor mat, which has a fastener tape with a positioning mark written thereon, looks attractive when laid on a floor, eliminates the need to fix the end portion of the fastener tape to the floor, prevents the positioning mark from being worn away, and is made up of mat units that can be carried in safety.

To achieve this object, the present invention provides a floor mat which comprises: a plurality of mat units, each including a side edge portion, an outer layer on which a floor mark used for an indoor sport is painted at a predetermined position, and a cushion layer adhered to the lower side of the outer layer; and a slide fastener for fastening the side edge portions of a pair of mat units together, the slide fastener including: a first fastener tape which has a first guide portion extending along the side edge portion of one of the paired mat units; a second fastener tape which has a second guide portion extending along the side edge portion of the other one of the paired mat units; and a slider which can be removably fitted around the first and second fastener tapes and is movable along the first and second guide portions in the longitudinal direction of the first and second fastener tapes. The first fastener tape is sandwiched between the outer layer and the cushion layer of the one mat unit and is adhered to the outer layer, while the second fastener tape is sandwiched between the outer layer and the cushion layer of the other one of the paired mat units and is adhered to the outer layer. Each fastener tape has non-tooth guide sections which are longer than the length of the slider and around which the slider can be movably fitted, and a teeth section continuous to the non-tooth guide section and engageable with another teeth section. Each fastener tape has a length substantially the same as that of the mat unit and is covered with the outer layer of the mat unit. Each fastener tape includes a non-adhesion section which is not adhered to the outer layer and which extends from one end of the fastener tape over the range of the non-tooth guide section. The non-adhesion section has a positioning mark, located within the range of the non-tooth guide section, for adjusting the positions of the floor marks of the mat units. The positioning mark is written at a location which is away from the floor mark by a predetermined distance.

To fasten the mat units of the present invention together, that portion of the outer layer which is located on the non-adhesion section is turned over, to expose the end portion of the fastener tape. After the slider is fitted around the guide portions of a pair of fastener tapes, the positions of the fastener tapes are adjusted, with the slider located at the non-tooth guide section, such that the positioning marks on the fastener tapes corresponds to each other. After this adjustment, the slider is moved along the teeth sections, thereby fastening the paired mat units together.

The floor mat of the present invention looks attractive since the end portion of the fastener tape is not projected from each mat unit. In addition, since the end portion of the fastener tape is covered with the outer layer, the positioning mark written on the end portion is prevented from being worn away. Further, the end portion of the fastener tape need not be fixed to the floor by means of an adhesive tape or the like. Still further, the end portion of the fastener tape does not touch or scratch the body of a person when the mat units are carried.

DETAILED DESCRIPTION OF THE PREFERRED EMBODIMENTS

The first embodiment of the present invention will now be described, with reference to FIGS. 1 through 6.

Figure 6:
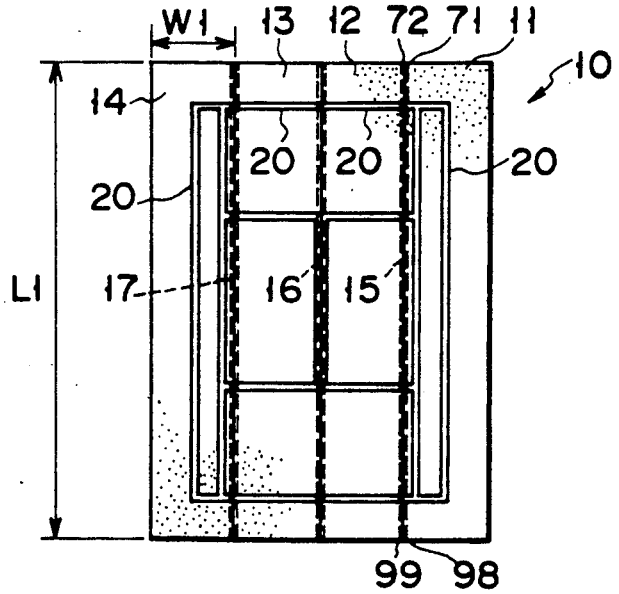
FIG. 6 is a plan view of the entire floor mat shown in FIG. 1.

The indoor sport flow mat shown in FIG. 6 comprises a plurality of mat units (e.g., four mat units 11, 12, 13 and 14), and slide fasteners 15, 16 and 17. Each of the mat units 11–14 has a predetermined length L1 and a predetermined width W1. Lines 20 (i.e., an example of a floor mark used for a sport game) are painted at predetermined locations on the surface of the mat units 11–14.

The coupling structure between mat units 11 and 12, that between mat units 12 and 13, and that between mat units 13 and 14 are similar to one another. Therefore, only the coupling structure between mat units 11 and 12 will be referred to in the descriptions below.

Figure 4:
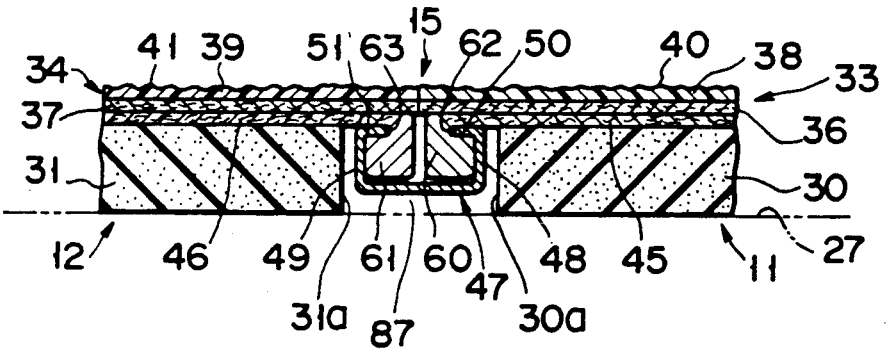
FIG. 4 is a sectional view taken along line IV—IV in FIG. 2.

Mat units 11 and 12 comprise side edge portions 25 and 26, respectively, which opposes each other. These side edge portions 25 and 26 can be fastened to each other by means of a slide fastener 15. As is shown in FIG. 4, mat unit 11 further comprises a cushion layer 30 to be placed on a floor 27, and an outer layer 33 laid on the cushion layer 30. Likewise, mat unit 12 further comprises a cushion layer 31 to be placed on the floor 27, and an outer layer 34 laid on the cushion layer 31. The outer layers 33 and 34 are adhered to the cushion layers 30 and 31, respectively, and also to the fastener tapes 45 and 46 (which will mentioned below), respectively.

The structural components of mat unit 11 are similar to those of mat unit 12. In the descriptions below, therefore, only the structural components of mat unit 11 will be mentioned, and the structural components of mat unit 12 will be indicated by the reference numerals enclosed in the parentheses, unless otherwise referred to.

The cushion layer 30 (31) is, e.g., a sponge-like synthetic resin foam sheet having a thickness of several mm. The outer layer 33 (34) is made up of: e.g. a base cloth 36 (37) formed of non-shrinking polyester fibers; and a coating layer 38 (39) formed of synthetic resin paint and coated on the base cloth 36 (37). The surface of the coating layer 38 (39) has a large number of tiny projections and depressions 40 (41), so that a player does not slip on the surface of the coating layer 38 (39). The lines 20 are painted at predetermined locations on the surface of the coating layer 38 (39).

Figure 1:
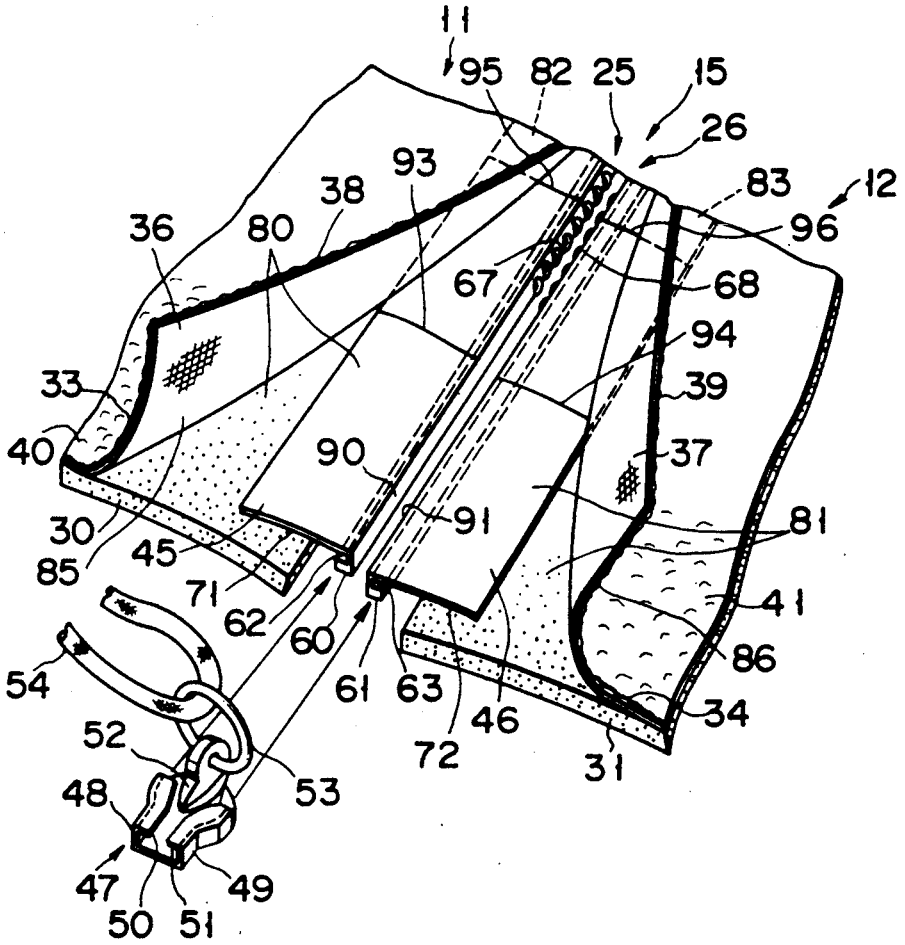
FIG. 1 is a perspective view of a floor mat according to the first embodiment of the present invention, and illustrates the unfastened state of mat units.
Figure 2:
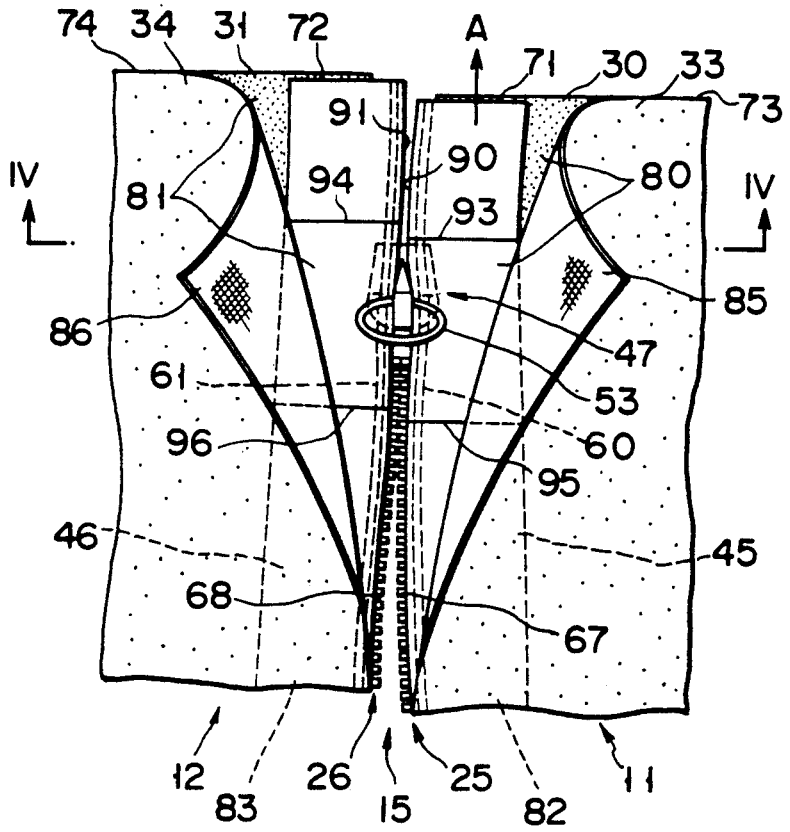
FIG. 2 is a plan view of the floor mat shown in FIG. 1, and illustrates a state where a slider is located at a non-tooth guide section.

As is shown in FIGS. 1 and 2, the slide fastener 15 comprises a first fastener tape 45, a second fastener tape 46, and a slider 47. The slider 47 is made up of a pair of side walls 48 and 49, a pair of guide edges 50 and 51, a separator 52, and a pull ring 53. A cord 54 is connected to the pull ring 53, for easy handling of the slider 47.

The fastener tape 45 (46) has a guide portion 60 (61) formed along the overall length thereof. A groove 62 (63) is formed in the guide portion 60 (61). The guide edges 50 and 51 of the slider 47 can be fitted in the respective grooves 62 and 63.

The first and second fastener tapes 45 and 46 have first and second teeth sections 67 and 68, respectively, each including a large number of teeth. The teeth of the first teeth section 67 and those of the second teeth section 68 interlock with each other when the slider 47 is moved along them.

The length of the fastener tape 45 (46) is substantially the same as length L1 of the mat unit 11 (12). The fastener tape 45 (46) is sandwiched between the cushion layer 30 (31) and the outer layer 33 (34) of the mat unit 11 (12), and is adhered to the outer layer 33 (34). The end 71 (72) of the fastener tape 45 (46) is located at substantially the same position as the end 73 (74) of the mat unit 11 (12), so that the fastener tape 45 (46) is covered with the outer layer 33 (34) throughout.

Figure 3:
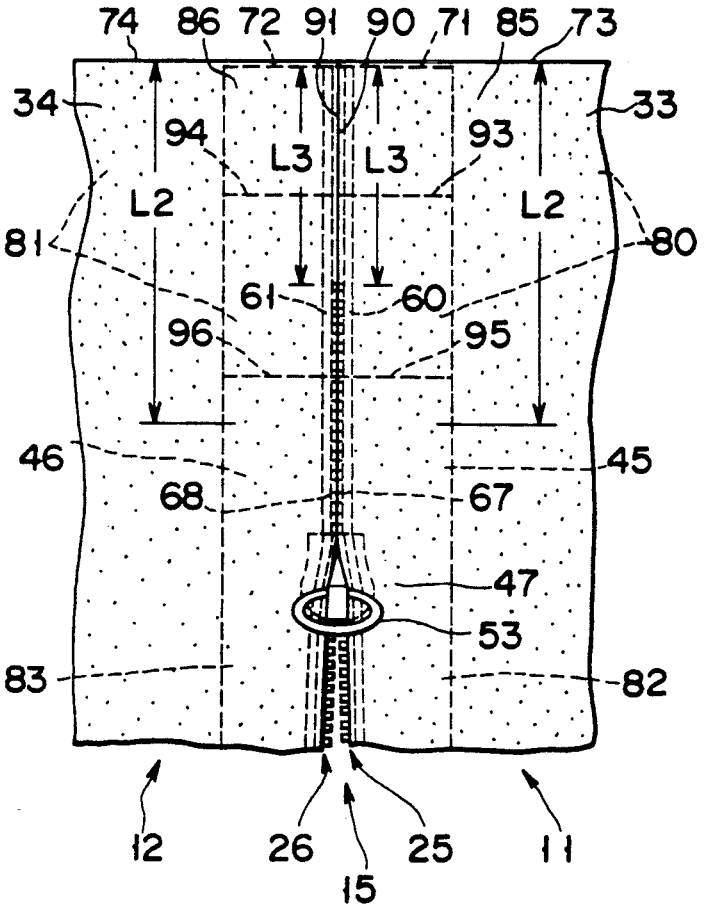
FIG. 3 is a plan view of the floor mat shown in FIG. 2, and illustrates a state where the mat units are being fastened together.

A non-adhesion section 80 (81), which is not adhered to the outer layer 33 (34), is provided from the end 71 (72) of the fastener tape 45 (46) in such a manner as to have the length indicated by L2 in FIG. 3. That portion 82 (83) of the fastener tape 45 (46) which is other than the non-adhesion section 80 (81) is adhered to the outer layer 33 (34). In the non-adhesion section 80 (81), therefore, the end portion 85 (86) of the outer layer 33 (34) can be turned over. As is shown in FIG. 4, a gap 87 allowing passage of the slider 47 is defined between the side edges 30*a* and 31*a* of the cushion layers 30 and 31.

In the non-adhesion section 80 (81) of the fastener tape 45 (46), a non-tooth guide section 90 (91) is provided from the end 71 (72) of the fastener tape 45 (46) in such a manner as to have the length indicated by L3 in FIG. 3. The non-tooth guide section 90 (91) is shorter than the non-adhesion section 80 (81), i.e. $L3 < L2$, but is longer than the slider 47.

In the non-adhesion section 80 (81), a first positioning mark 93 (94) and a second positioning mark 95 (96) are provided on the surface of the fastener tape 45 (46). The first positioning mark 93 (94) is located in the range of the non-tooth guide section 90 (91), while the second positioning mark 95 (96) is located in the teeth section 67 (68).

Figure 5:
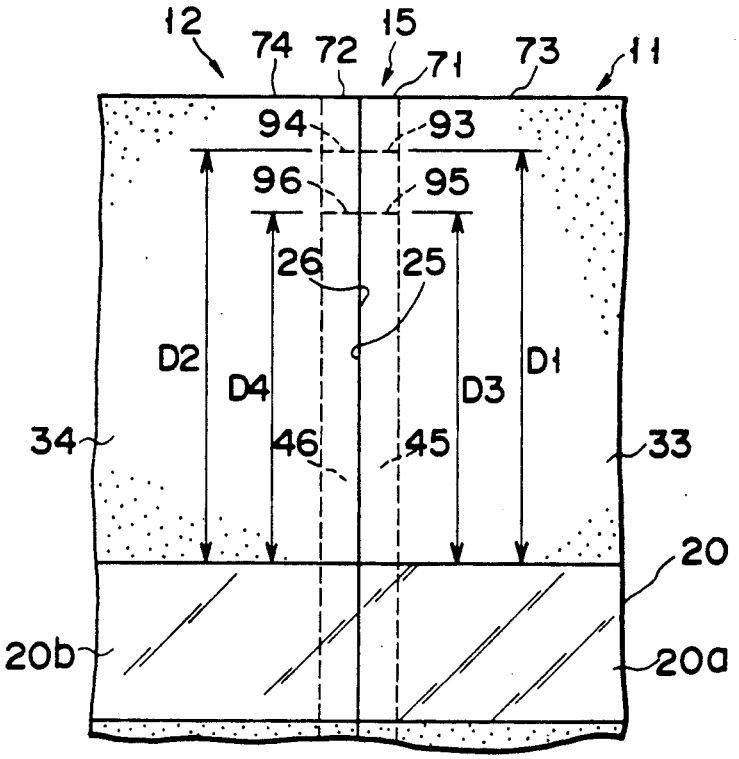
FIG. 5 is a plan view of the floor mat shown in FIG. 1, and illustrates the fastened state of mat units.

As is shown in FIG. 5, distance D1 between the first positioning mark 93 and line 20*a* painted on mat unit 11 is equal to distance D2 between the first positioning mark 94 and the line 20*b* painted on mat unit 12. Further, distance D3 between the second positioning mark 95 and line 20*a* painted on mat unit 11 is equal to distance D4 between the second positioning mark 96 and line 20*b* painted on mat unit 12.

To fasten mat units 11 and 12 to each other, the fastener tapes 45 and 46 are laid adjacent to each other, as is shown in FIG. 1. Then, the end portions 85 and 86 of the outer layer 33 and 34 are turned over. In this state, the guide edges 50 and 51 of the slider 47 are fitted in the grooves 62 and 63 of the non-tooth guide sections 90 and 91. When the slider 47 is at the non-tooth guide sections 90 and 91, the fastener tapes 45 and 46 can be moved relative to each other in the longitudinal direction thereof. Thus, the first positioning marks 93 and 94 are adjusted to make them located at the same position. For instance, the first fastener tape 45 is moved in the direction indicated by A in FIG. 2, such that the first positioning marks 93 and 94 come to the same position. Thereafter, the slider 47 is moved along the teeth sections 67 and 68.

With the above procedures, the teeth sections 67 and 68 interlock with each other, as is shown in FIG. 3. The teeth sections 67 and 68 completely interlock with each other, when the slider 47 has been moved to the terminating ends 98 and 99 of the tapes 45 and 46. Simultaneous with the interlocking of the teeth sections 67 and 68, the lines 20 painted on one mat unit 11 and those painted on the other 12 are made to completely conform to each other in position. Since the end portion 85 (86) of the outer layer 33 (34) can be laid over the cushion layer 30 (31), the positioning marks 93–96 can be covered with the end portions 85 and 86.

The second positioning marks 95 and 96 are located in the range of the teeth sections 67 and 68, respectively. Therefore, if the second positioning marks 95 and 96 are lined up before the slider 47 is pulled, the teeth sections 67 and 68 can interlock with each other at their optimal positions.

After it is confirmed that the second positioning marks 95 and 96 line up, the slider 47 is pulled to the terminating ends 98 and 99 of the teeth sections 67 and 68, to thereby cause the teeth sections 67 and 68 to completely interlock with each other. Thereafter, the slider 47 is removed from the teeth sections 67 and 68 at the location of the terminating ends 98 and 99. It should be noted that the teeth sections 67 and 68 do not separate at a longitudinally intermediate point thereof, once they are interlock. Therefore, the teeth sections 67 and 68 do not disengage from each other even if the mat units 11 and 12 are exerted with a force which acts in such a way as to separate the mat units 11 and 12 from each other.

To carry the floor mat 10 or keep it in storage, the mat units 11 and 12 are unfastened and separated from each other. To unfasten the mat units 11 and 12, the teeth sections 67 and 68 are separated from the terminating ends 98 and 99 of the fastener tapes 45 and 46 or from the non-tooth guide sections 90 and 91. By so doing, the mat units 11 and 12 can be easily separated from each other. In should be noted that the slider 47 is kept removed from the faster tapes 45 and 46 during the unfastening operation.

Figure 7:
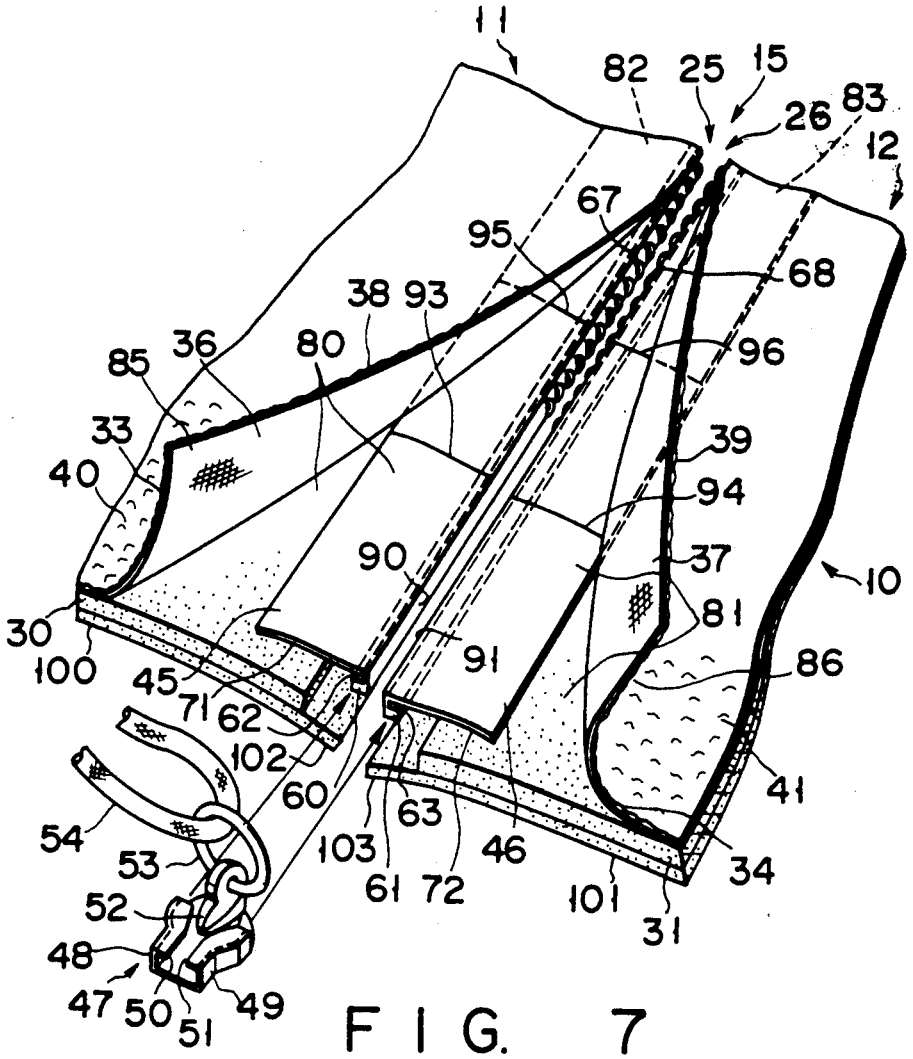
FIG. 7 is a perspective view of a floor mat according to the second embodiment of the present invention, and illustrates the unfastened state of mat units.
Figure 8:
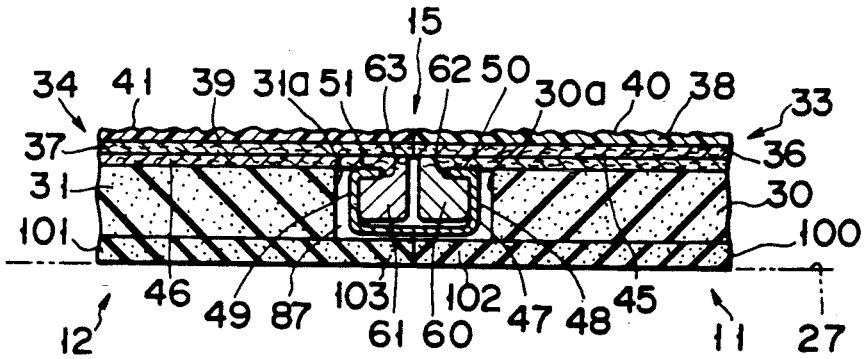
FIG. 8 is a sectional view of the floor mat shown in FIG. 7, and illustrates a state where a slider is located at a non-tooth guide section.
Figure 9:
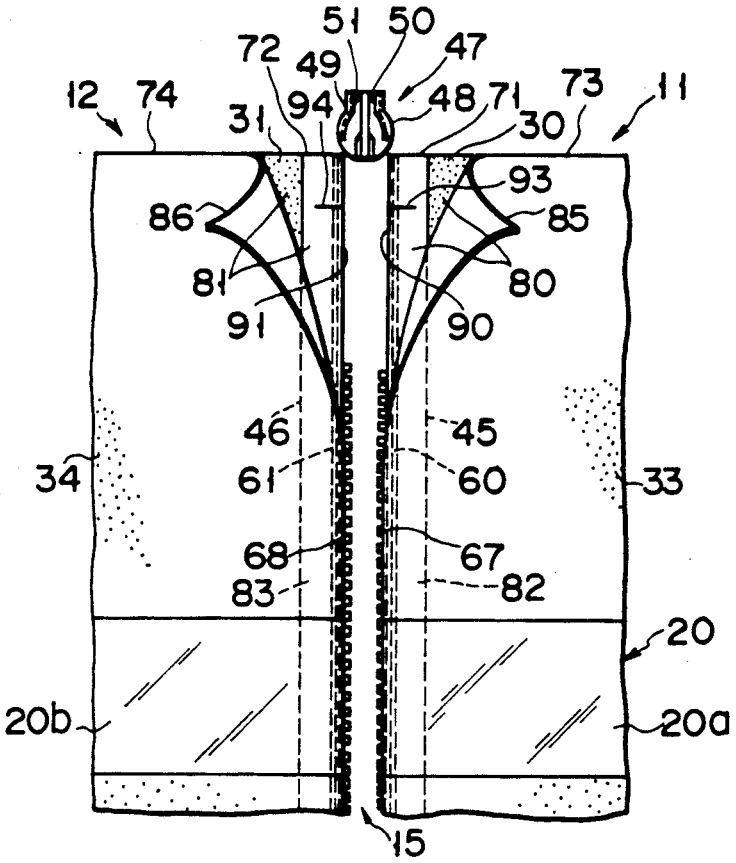
FIG. 9 is a perspective view of a floor mat according to the third embodiment of the present invention, and illustrates the unfastened state of mat units.
Figure 10:
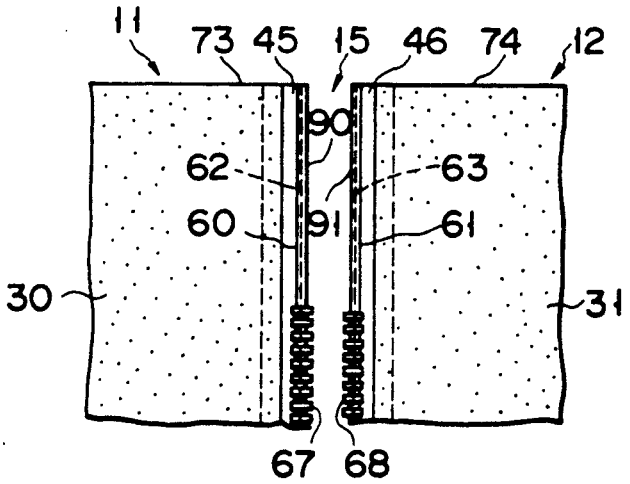
FIG. 10 is a bottom view of part of the floor mat shown in FIG. 9.
Figure 11:
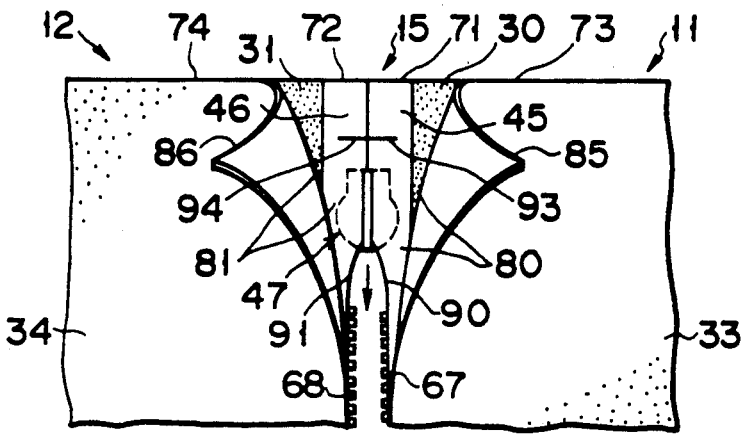
FIG. 11 is a plan view of the floor mat shown in FIG. 9, and illustrates a state where the mat units are being fastened together.
Figure 12:
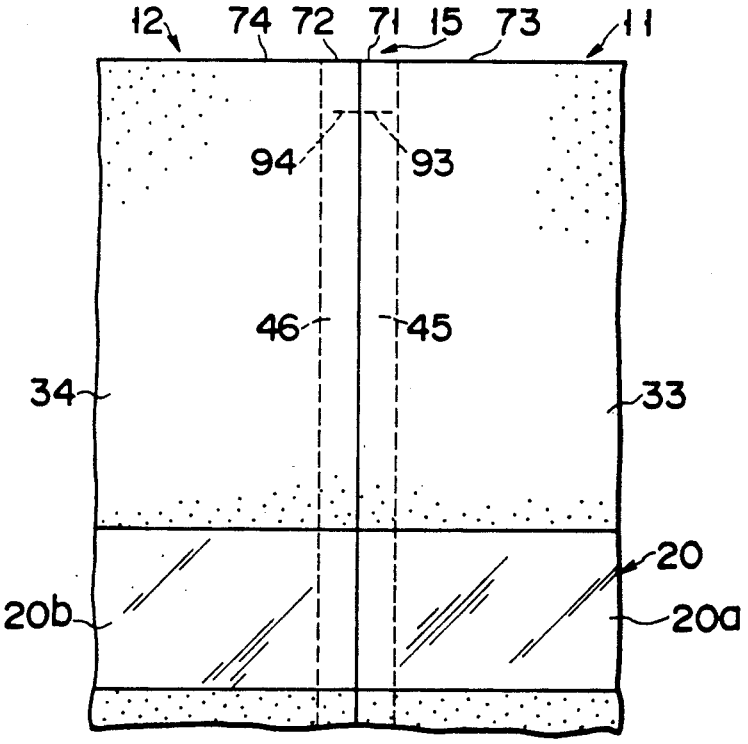
FIG. 12 is a plan view of the floor mat shown in FIG. 9, and illustrates the fastened state of mat units.

FIGS. 7 and 8 show the second embodiment of the present invention. In the second embodiment, a protective liner 100 (101) is provided on the reverse side of the cushion layer 30 (31) of mat unit 11 (12). The side portion 102 (103) of the protective liner 100 (101) is located between the teeth section 67 (68) of the fastener tape 45 (46) and the floor 27, and extends along the overall length of the teeth section 67 (68). With this construction, the lower region of the gap 87 is closed. Due to the provision of the protective liners, the dust and sand on the floor or other undesirable objects are prevented from entering the interiors of the teeth sections 67 and 68. Further, the protective liners 100 and 101 serve to prevent the floor 27 from being scratched by the slider 47 when this slider 47 is moved.

FIGS. 9 through 12 show the third embodiment of the present invention. In the third embodiment, only the first positioning mark 93 (94) is provided on the surface of the fastener tape 45 (46) of mat unit 11(12). Except for this point, the third embodiment is similar to the foregoing embodiments in both structure and operation. Needless to say, the object of the present invention is achieved with the third embodiment as well.

The foregoing embodiments were described, referring to the case where the floor mark constitutes tennis court lines. However, the floor mark may be lines for a badminton court, a volleyball court, a dodge ball court, etc. Further, the present invention may be applied to a floor mat on which a plurality of sport game tables, such as table-tennis tables, are placed. In this case, marks indicating the positions at which the sport game tables should be placed are painted on the floor mat.

What is claimed is:

1. A floor mat to be laid on a floor for an indoor sport, comprising:

a plurality of mat units, each including:

a side edge portion to be laid adjacent to a side edge portion of another;

an outer layer on which a floor mark used for the indoor sport is painted at a predetermined position, and a cushion layer adhered to the lower side of the outer layer; and a slide fastener for fastening the side edge portions of a pair of mat units together, said slide fastener including:

a first fastener tape which has a first guide portion extending along the side edge portion of one of the paired mat units;

a second fastener tape which has a second guide portion extending along the side edge portion of the other one of the paired mat units; and a slider which can be removably fitted around the first and second fastener tapes and is movable along the first and second guide portions in a longitudinal direction thereof;

said first fastener tape being sandwiched between the outer layer and the cushion layer of said one mat unit and being adhered to the outer layer, while the second fastener tape being sandwiched between the outer layer and the cushion layer of said the other mat unit and being adhered to the outer layer;

each of said first and second fastener tapes having:

a length substantially the same as that of the mat unit;

non-tooth guide sections which extend from respective ends to be longer than the length of the slider and around which the slider can be movably fitted; and a teeth section continuous to the non-tooth guide sections and engageable with another teeth section;

each of said first and second fastener tapes being covered with the outer layer of the mat unit;

each of said first and second fastener tapes including a non-adhesion section which is not adhered to the outer layer and which extends from one end of the fastener tape over a range of the non-tooth guide section; and said non-adhesion section having a positioning mark, located within the range of the non-tooth guide section, for adjusting the positions of the floor marks of the mat units, said positioning mark being indicated at a location which is away from the floor mark by a predetermined distance.

2. A floor mat according to claim 1, wherein said non-adhesion section of each mat unit has a second positioning mark, located within the range of the teeth section, for adjusting the positions of the floor marks of the mat units.

3. A floor mat according to claim 1, wherein said outer layer of each mat unit includes a base cloth; and a coating layer coated on the base cloth and having small projections and depressions thereon for preventing slipping, said floor mark being painted on the coating layer.

4. A floor mat to be laid on a floor for an indoor sport, comprising:

a plurality of mat units, each including:

a side edge portion to be laid adjacent to a side edge portion of another;

an outer layer on which a floor mark used for the indoor sport is painted at a predetermined position, and a cushion layer adhered to the lower side of the outer layer; and a slider fastener for fastening the side edge portions of a pair of mat units together, said slide fastener including:

a first fastener tape which has a first guide portion extending along the side edge portion of one of the paired mat units;

a second fastener tape which has a second guide portion extending along the side edge portion of the other one of the paired mat units; and a slider which can be removably fitted around the first and second fastener tapes and is movable along the first and second guide portions in a longitudinal direction thereof;

said first fastener tape being sandwiched between the outer layer and the cushion layer of said one mat unit and being adhered to the outer layer, while the second fastener tape being sandwiched between the outer layer and the cushion layer of said the other mat unit and being adhered to the outer layer;

each of said first and second fastener tapes having:

non-tooth guide sections which extend from respective ends to be longer than the length of the slider and around which the slider can be movably fitted; and a teeth section continuous to the non-tooth guide sections and engageable with another teeth section;

each of said first and second fastener tapes being covered with the outer layer of the mat unit;

each of said first and second fastener tapes including a non-adhesion section which is not adhered to the outer layer and which extends from one end of the fastener tape over a range of the non-tooth guide section; and said non-adhesion section having a positioning mark, located within the range of the non-tooth guide section, for adjusting the positions of the floor marks of the mat units, said positioning mark being indicated at a location which is away from the floor mark by a predetermined distance; and a protective liner formed under the cushion layer of each mat unit, said protective liner having a side edge portion which is to be located between the teeth section of the fastener tape and the floor when the floor mat is laid on the floor.

5. A floor mat according to claim 4, wherein said non-adhesion section of each mat unit has a second positioning mark, located within the range of the teeth section, for adjusting the positions of the floor marks of the mat units.

6. A floor mat according to claim 4, wherein said outer layer of each mat unit includes a base cloth; and a coating layer coated on the base cloth and having small projections and depressions thereon for preventing slipping, said floor mark being painted on the coating layer.

* * * * *